US012318885B2

(12) United States Patent
Chen

(10) Patent No.: US 12,318,885 B2
(45) Date of Patent: Jun. 3, 2025

(54) SANDING DISC STABILIZING STRUCTURE OF ORBITAL SANDER

(71) Applicant: X'POLE PRECISION TOOLS INC., Taoyuan (TW)

(72) Inventor: Bach Pangho Chen, Claremont, CA (US)

(73) Assignee: X'POLE PRECISION TOOLS INC., Taoyuan (TW)

( * ) Notice: Subject to any disclaimer, the term of this patent is extended or adjusted under 35 U.S.C. 154(b) by 691 days.

(21) Appl. No.: 17/446,952

(22) Filed: Sep. 3, 2021

(65) Prior Publication Data

US 2023/0072828 A1 Mar. 9, 2023

(51) Int. Cl.

| | |
|---|---|
| ***B24B 41/04*** | (2006.01) |
| ***B24B 23/04*** | (2006.01) |
| ***B24B 41/00*** | (2006.01) |
| ***B24B 45/00*** | (2006.01) |
| ***B24B 55/05*** | (2006.01) |

(52) U.S. Cl.

CPC ..... *B24B 41/042* (2013.01); *B24B 23/046* (2013.01); *B24B 41/002* (2013.01); *B24B 45/00* (2013.01); *B24B 55/055* (2013.01)

(58) Field of Classification Search

CPC ..... B24B 23/046; B24B 23/04; B24B 23/03; B24B 41/0475; B24B 41/007; B24B 41/00

USPC ..... 451/357, 270

See application file for complete search history.

(56) References Cited

U.S. PATENT DOCUMENTS

| | | | | |
|---|---|---|---|---|
| 2,639,564 | A * | 5/1953 | Atkin | B24B 23/04 451/357 |
| 2,786,950 | A * | 3/1957 | Carmichael | H02K 33/04 451/356 |
| 4,837,981 | A * | 6/1989 | Hashii | B24B 23/04 451/518 |
| 6,979,254 | B1 * | 12/2005 | Huber | B24B 23/026 451/344 |
| 9,833,871 | B2 * | 12/2017 | Fron{hacek | B24D 15/04 |
| 2001/0003087 | A1 * | 6/2001 | Oda | B24B 41/007 451/357 |

(Continued)

FOREIGN PATENT DOCUMENTS

| | | | |
|---|---|---|---|
| CN | 205184482 | U | 4/2016 |
| CN | 105922106 | A | 9/2016 |

(Continued)

*Primary Examiner* — Brian D Keller
*Assistant Examiner* — Dana Lee Poon
(74) *Attorney, Agent, or Firm* — MUNCY, GEISSLER, OLDS & LOWE, P.C.

(57) ABSTRACT

A sanding disc stabilizing structure of an orbital sander comprises a casing, a sanding power source, a sanding disc, and at least four springs. The sanding power source is assembled on the casing and comprises a drive shaft and a tool holder disposed on the drive shaft and offset from an axis of the drive shaft. The center of the sanding disc driven by the sanding power source to perform an orbital motion is disposed on the tool holder with a locking screw. Two ends of each of the at least four springs are respectively disposed on the casing and the sanding disc. The free length of each of at least four springs is greater than the spacing between an installation part of the casing and an installation part of the sanding disc provided for one of the at least four springs.

7 Claims, 8 Drawing Sheets

(56) References Cited

U.S. PATENT DOCUMENTS

| | | | | |
|---|---|---|---|---|
| 2003/0017795 | A1* | 1/2003 | Walker | B24B 23/04 451/356 |
| 2010/0048101 | A1* | 2/2010 | King | B24B 45/006 451/28 |
| 2014/0370790 | A1* | 12/2014 | Chen | B24B 41/007 451/344 |
| 2019/0247973 | A1* | 8/2019 | Zhong | B24B 55/00 |
| 2019/0275634 | A1* | 9/2019 | White | B25J 9/0009 |
| 2020/0030937 | A1* | 1/2020 | Chen | B24B 49/04 |

FOREIGN PATENT DOCUMENTS

| | | | |
|---|---|---|---|
| CN | 105983893 | A | 10/2016 |
| EP | 2815843 | A1 | 12/2014 |
| GB | 2104422 | A | 3/1983 |
| JP | 2004066420 | A | 3/2004 |
| JP | 3694342 | B2 | 7/2005 |
| JP | 2013220493 | A | 10/2013 |
| JP | 2016030303 | A | 3/2016 |

* cited by examiner

SANDING DISC STABILIZING STRUCTURE OF ORBITAL SANDER

FIELD OF THE INVENTION

The invention relates to a sanding disc stabilizing structure of an orbital sander, and more particularly to a sanding disc stabilizing structure capable of solving the problem that an edge of a sanding disc being risen improperly when a conventional orbital sander is rotating.

BACKGROUND OF THE INVENTION

The motion modes of sander tool are as follows: rotational motion, reciprocating motion, orbital motion and random orbital motion. Among them, a sander that performs sanding on a sanded object by orbital motion is called an orbital sander. The basic structure of the orbital sander is as follows: a power motor is disposed in a casing to which the orbital sander belongs, a spindle of the power motor is assembled with an eccentric device to form an eccentric shaft, and the eccentric shaft drives a sanding disc to perform motion through a bearing.

When the eccentric shaft of the orbital sander drives the sanding disc to perform an eccentric orbital motion, the sanding disc is affected by rotational inertia (also known as the moment of inertia) to produce drifting-like vibration. The vibration results in the sanding disc performing sanding in unstable orbital motion, and affects the final sanding effect.

The solution to the aforementioned problems is to provide a pad support between the casing and the sanding disc. The pad support is used to limit the vibration of the sanding disc caused by the moment of inertia, so that the sanding disc is kept within a range of pendulum diameter to perform stable orbital motion. The existing pad support comprises two implementation modes, one of the modes is the railing pad support (as shown by 40 in FIG. 1), and the other is the cylindrical pad support (as shown by 50 in FIG. 2). The railing pad support is as disclosed in U.S. Pat. No. 6,979,254, EP2815843, JP2016030303A, and JP2013220493A. The cylindrical pad support is as disclosed in patents JP2004066420A, JP3694342B2, CN205184482U, CN105983893A, CN105922106A, and GB2104422A.

When the orbital sander operates, the eccentric displacement is about 10,000 to 12,000 times per minute, it will reach hundreds of thousands of times per hour under continuous operation, and about 15 million times per day. It also means that the pad support is pulled continuously while the orbital sander is operating. When the orbital sander is assembled on a robotic arm to operate all day, the number of times the pad support being pulled will reach ten millions per day, which is difficult for the service life of the pad support.

Although the pad supports of the foregoing two implementation modes comprise the characteristic of being able to be bent, the pad supports themselves do not comprise the characteristic of stretching. The length of the pad support is unable to be increased by external force. When the orbital sander is operating, the sanding disc is driven by the eccentric shaft to produce eccentric displacement. The position of the pad support disposed on the sanding disc deviates from the position of the pad support disposed on the casing, causing the direct distance between the position of the pad support disposed on the sanding disc and the position of the pad support disposed on the casing to become longer. The reason for the longer direct distance is explained by a right-angled triangle. When the orbital sander is not operating, the pad support is in the same state as the opposite side of the right-angled triangle (as shown by 41 in FIG. 3). When the orbital sander is operating, the offset caused by the position of the pad support disposing on the sanding disc is the adjacent side of the right-angled triangle (as shown by 42 in FIG. 3). At the moment, the distance between the position of the pad support disposed on the sanding disc and the position of the pad support disposed on the casing is the hypotenuse of the right-angled triangle (as shown by 43 in FIG. 3). It can be directly understood from the basic concept of the right-angled triangle that the hypotenuse 43 of the right-angled triangle is longer than the opposite side 41, which proves the aforementioned description of this paragraph. However, since the pad support comprises non-tensile property, the pad support is incapable of coping with the problem of longer direct distance, causing the edge area of the sanding disc to be risen improperly (as indicated by 60 in FIG. 3). The risen sanding disc loses accurate flatness, which affects the sanding quality.

Furthermore, since the existing pad support is incapable of stretching, the eccentric displacement distance of the sanding disc of the orbital sander is limited. As the result, the existing sander is unable to be implemented with a large eccentric distance.

SUMMARY OF THE INVENTION

A main object of the invention is to solve the problem that an edge of a sanding disc is improperly risen when the sanding disc is rotating due to the installation of a pad support in an orbital sander.

In order to achieve the above object, the invention provides a sanding disc stabilizing structure of an orbital sander comprising a casing, a sanding power source, a sanding disc, and at least four springs. The sanding power source is assembled in the casing and comprises a drive shaft and a tool holder disposed on the drive shaft and offset from an axis of the drive shaft. The center of the sanding disc is disposed on the tool holder with a locking screw, and the sanding disc is driven by the sanding power source to perform an orbital motion relative to the casing. Each of the at least four springs comprises a first end disposed on the casing and a second end disposed on the sanding disc. A free length of each of the at least four springs is greater than the spacing between an installation part of the casing provided for the first end and an installation part of the sanding disc provided for the second end. Each of the at least four springs is incompletely compressed in the spacing. During the orbital motion of the sanding disc, each of the at least four springs is stretched when the second end thereof deviates from a projection position of the first end.

In one embodiment, the casing is provided with a plurality of first installation holes, and each of the plurality of first installation holes is located at the installation part of the casing provided for the first end of each of the at least four springs.

In one embodiment, the casing comprises a plurality of first rubber sleeves respectively disposed in the plurality of first installation holes, and the first end of each of the at least four springs is disposed in one of the plurality of first rubber sleeves.

In one embodiment, each of the plurality of the first rubber sleeves comprises a first cap placed into one of the plurality of first installation holes, and a first flange extending from a periphery of the first cap and disposed at an opening edge of the first installation hole.

In one embodiment, the sanding disc is provided with a plurality of second installation holes, and each of the plurality of second installation holes is located at the installation part of the sanding disc provided for the second end of each of the at least four springs.

In one embodiment, the sanding disc comprises a base disc and a sanding pad disposed on the base disc, and the base disc is formed with the plurality of second installation holes on a side facing the casing.

In one embodiment, the sanding disc comprises a plurality of second rubber sleeves respectively disposed in the plurality of second installation holes, and the second end of each of the at least four springs is disposed in one of the plurality of second rubber sleeves.

In one embodiment, each of the plurality of the second rubber sleeves comprises a second cap placed into one of the plurality of second installation holes, and a second flange extending from a periphery of the second cap and disposed at an opening edge of the second installation hole.

In one embodiment, each of the at least four springs comprises a first assembling connector disposed at the first end and fixed to the casing through a first assembling element.

In one embodiment, each of the at least four springs comprises a second assembling connector disposed at the second end and provided for a second assembling element to dispose therein.

In one embodiment, the casing comprises a rectangular dust cover facing the sanding disc, and the at least four springs are located at corners of the rectangular dust cover.

In one embodiment, the installation part of the casing provided for the first end of each of the springs is a first protruding column.

In one embodiment, the installation part of the sanding disc provided for the second end of each of the springs is a second protruding column.

In one embodiment, the sanding disc is rectangular.

Accordingly, compared with the prior art, the invention has the following features: the invention replaces the springs with the conventional pad support design, and the free length of each of the at least four springs is greater than the spacing between the installation part of the casing provided for the first end and the installation part of the sanding disc provided for the second end. During the orbital motion of the sanding disc as the second end of each of the springs deviates from the projection position of the first end, the springs are stretched. The deformation of each of the at least four springs offsets a change of distance between the first end and the second end, so that the sanding disc is capable of maintaining stability.

DETAILED DESCRIPTION OF THE PREFERRED EMBODIMENTS

The detailed description and technical contents of the invention are described below with reference to the drawings.

Figure 1:
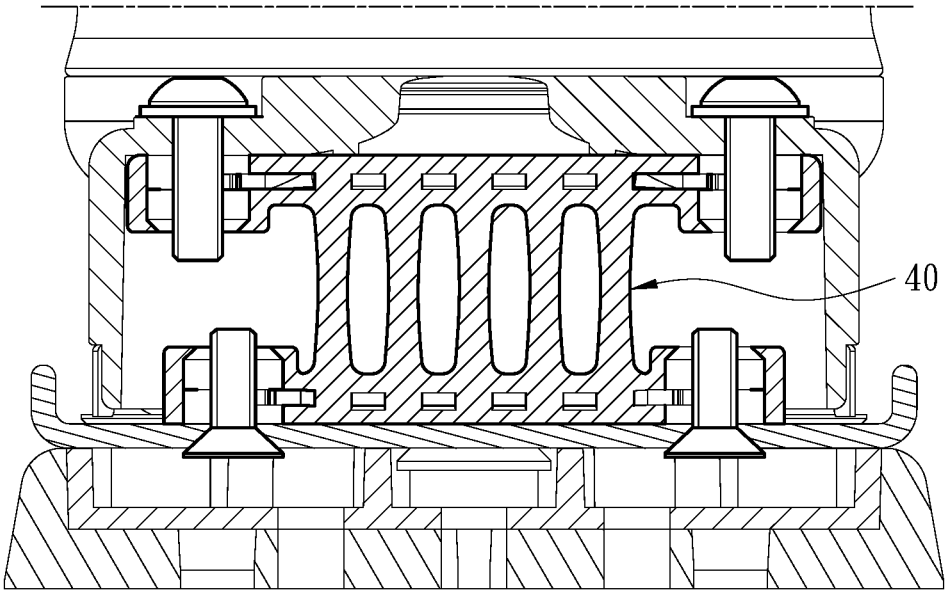
Fig. 1 PRIOR ART
FIG. 1 is a structural diagram of a conventional orbital sander implemented with a railing pad support.
Figure 2:
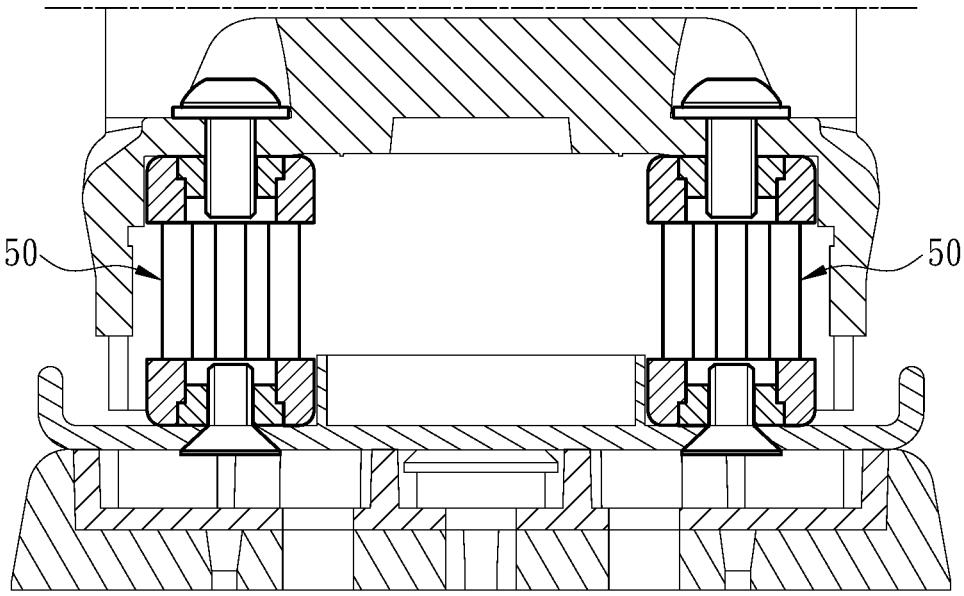
Fig. 2 PRIOR ART
FIG. 2 is a structural diagram of a conventional orbital sander implemented with a cylindrical pad support.
Figure 3:
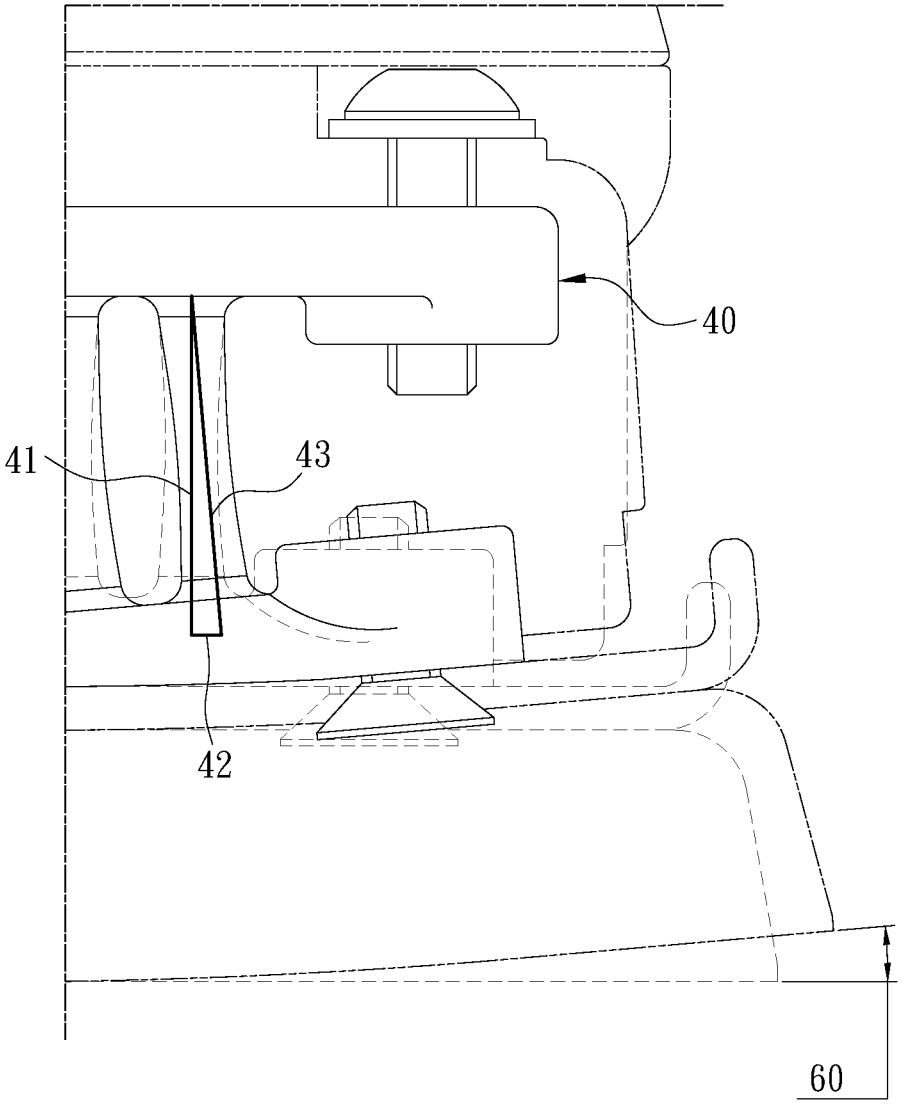
Fig. 3 PRIOR ART
FIG. 3 is an implementation diagram of a conventional orbital sander when an edge area of a sanding disc is improperly risen.
Figure 4:
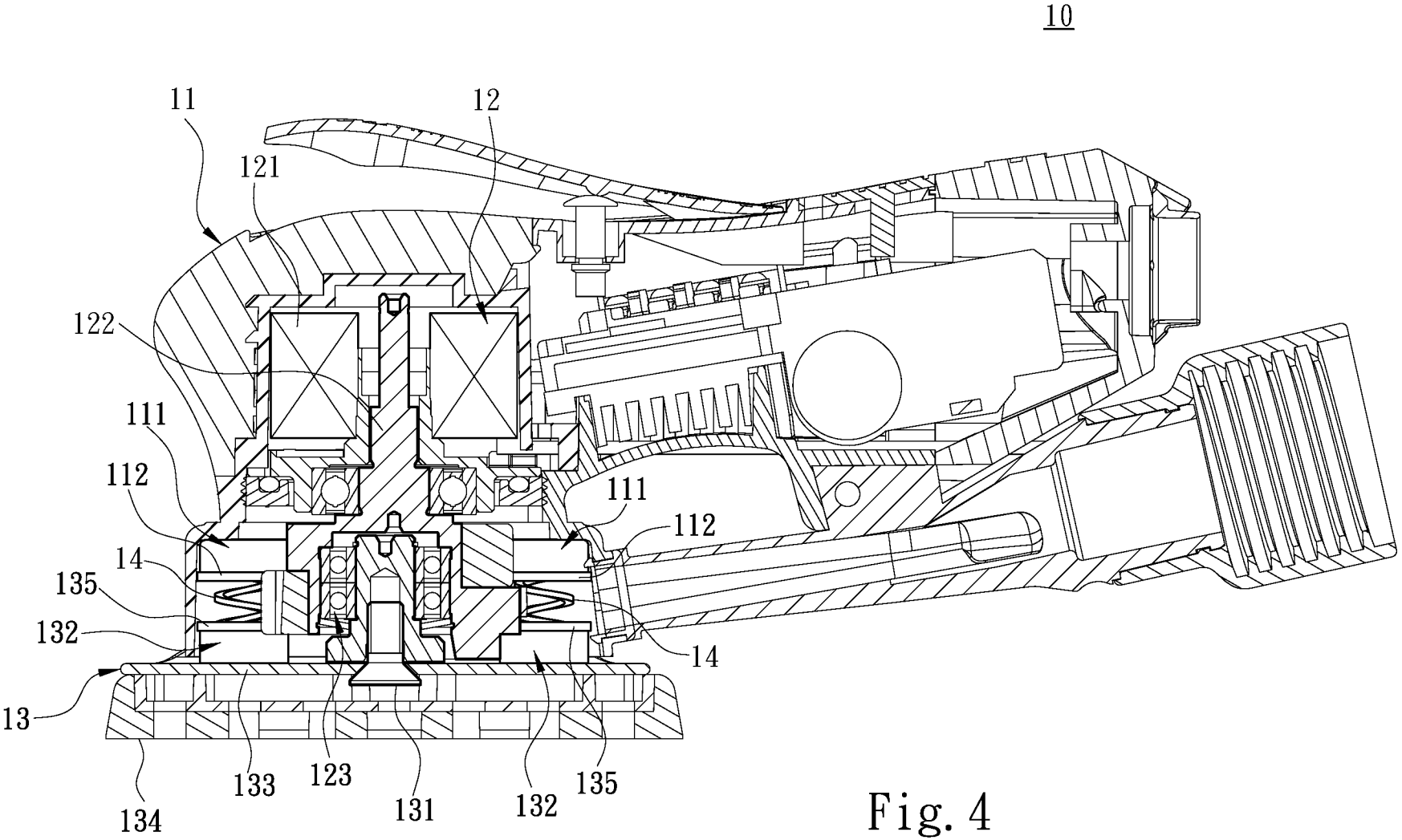
FIG. 4 is a cross-sectional view of a structure of an orbital sander according to a first embodiment of the invention.
Figure 5:
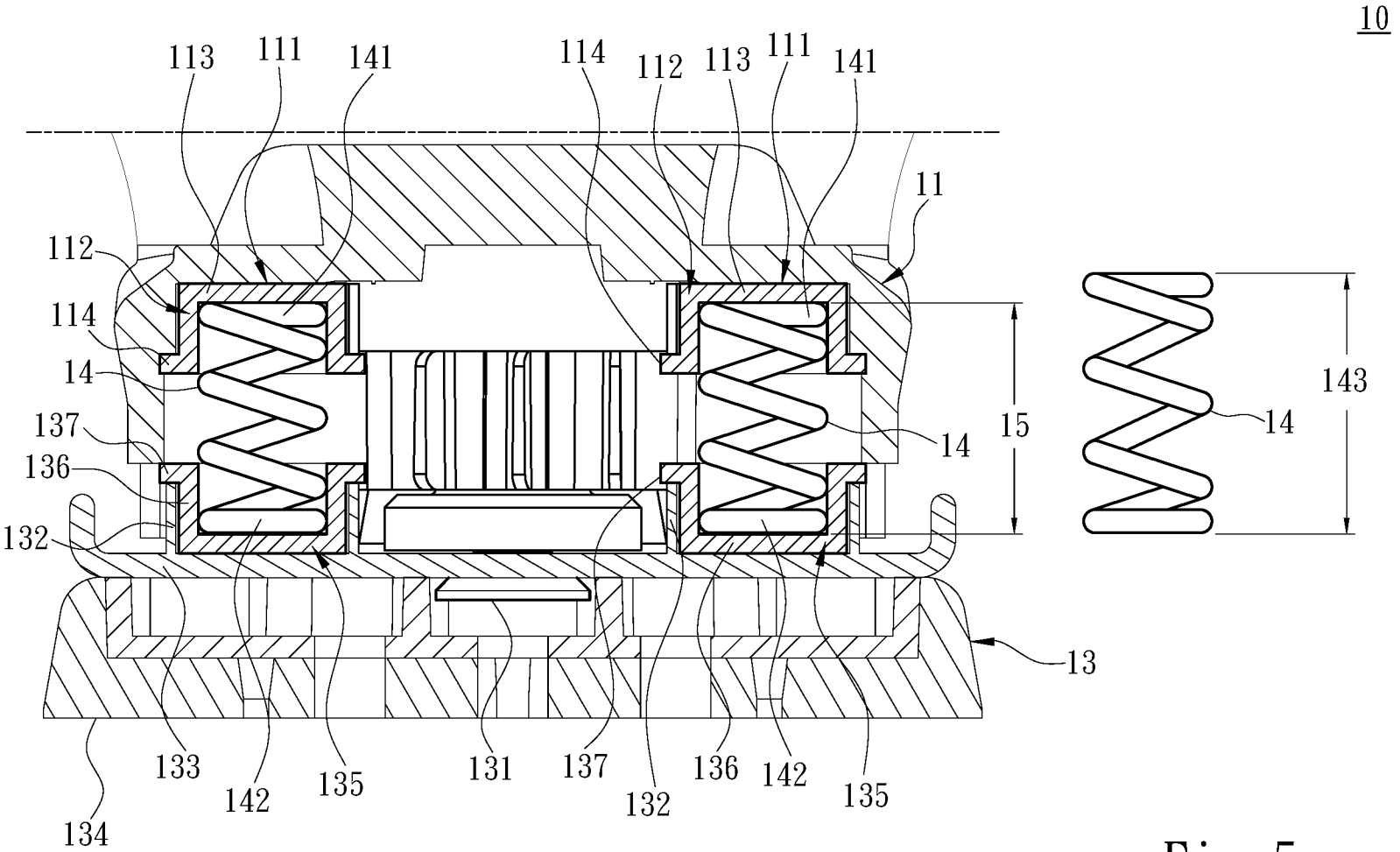
FIG. 5 is a structural diagram of a sanding disc stabilizing structure according to the first embodiment of the invention.

Please refer to FIG. 4 and FIG. 5, the invention provides a sanding disc stabilizing structure of an orbital sander 10. The orbital sander 10 is a hand-held machine tool that can be operated by a user. The sanding disc stabilizing structure comprises a casing 11, a sanding power source 12, a sanding disc 13, and at least four springs 14. The size of the casing 11 is designed for user's convenience, and is provided for disposing the sanding power source 12 therein. The sanding power source 12 comprises a motor 121, a drive shaft 122, and a tool holder 123. The motor 121 is selected from an air motor or an electric motor according to requirements, and is not limited by the figures of the invention. In one embodiment, the drive shaft 122 is implemented as a spindle of the motor 121, which means that a rotor of the motor 121 is disposed on the drive shaft 122. The tool holder 123 is disposed on the drive shaft 122. The center of the tool holder 123 is offset from the axis of the drive shaft 122. In addition, a center of the sanding disc 13 is disposed on the tool holder 123 with a locking screw 131, and the sanding disc 13 is driven by the sanding power source 12 to perform an orbital motion relative to the casing 11. Further, in one embodiment, the sanding disc 13 is rectangular.

Each of the at least four springs 14 comprises a first end 141 disposed on the casing 11 and a second end 142 disposed on the sanding disc 13. A free length 143 of each of the at least four springs 14 is greater than a spacing 15 between an installation part of the casing 11 provided for the first end 141 and an installation part of the sanding disc 13 provided for the second end 142. When each of the at least four springs 14 of the invention is assembled, as the free length 143 is greater than the spacing 15, each of the at least four springs 14 is pre-compressed. However, it should be noted that each of the at least four springs 14 is incompletely compressed in the spacing 15, so each of the at least four springs 14 is not a tension spring.

Figure 7:
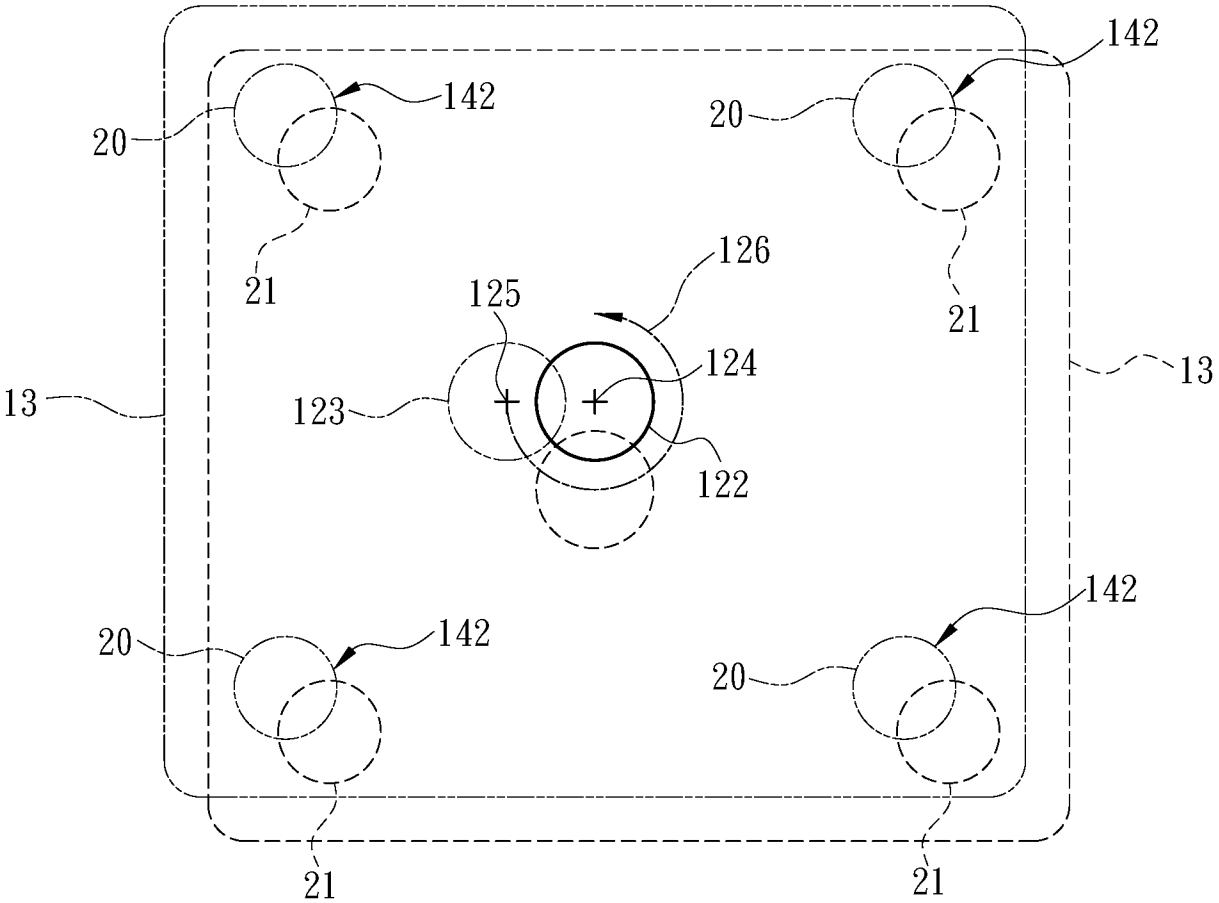
FIG. 7 is a schematic diagram of displacement of second ends of springs of the sanding disc stabilizing structure according to the first embodiment of the invention.

Please refer to FIG. 5 and FIG. 7, a way in which the sanding disc stabilizing structure of the invention being capable of maintaining the sanding disc 13 stable when the orbital sander 10 is started is explained hereinafter. First of all, FIG. 7 is a schematic drawing based on viewing from a bottom viewing angle or a top viewing angle of the orbital sander 10. In FIG. 7, reference number 124 is the axis of the drive shaft 122, reference number 125 is an axis of the tool holder 123, reference number 126 is a motion orbit of the axis of the tool holder 123 when being driven by the drive shaft 122, reference number 20 is an original position of the second end 142 of each of the at least four springs 14, and reference number 21 is a position of the second end 142 of each of the at least four springs 14 when being displaced along with the sanding disc 13. When the orbital sander 10 is started, the sanding power source 12 drives the sanding disc 13 to perform the orbital motion for sanding. As the sanding disc 13 moves based on the orbital motion, the second end 142 of each of the at least four springs 14 located on the sanding disc 13 deviates relative to the first end 141 of the spring 14 (as shown by 20, 21 in FIG. 7). As the second end 142 deviates from a projection position of the first end 141, a distance between the first end 141 and the second end 142 of each of the at least four springs 14 is longer than the spacing 15. At this time, the at least four springs 14 are stretched. Also, it should be understood that the stretching described in the invention is based on comparison of the at least four springs 14 when the sanding disc 13 is not in operation. The elongation of each of the at least four springs 14 exactly offsets is the same as the distance between the first end 141 and the second end 142, so that the sanding disc 13 can be maintained stable, which specifically solves the problem of the sanding disc 13 operating unsteadily caused by being conventionally assembled with a pad support. In addition, the invention also solves the problem of poor service life of the conventional pad support through the aforementioned design.

Figure 6:
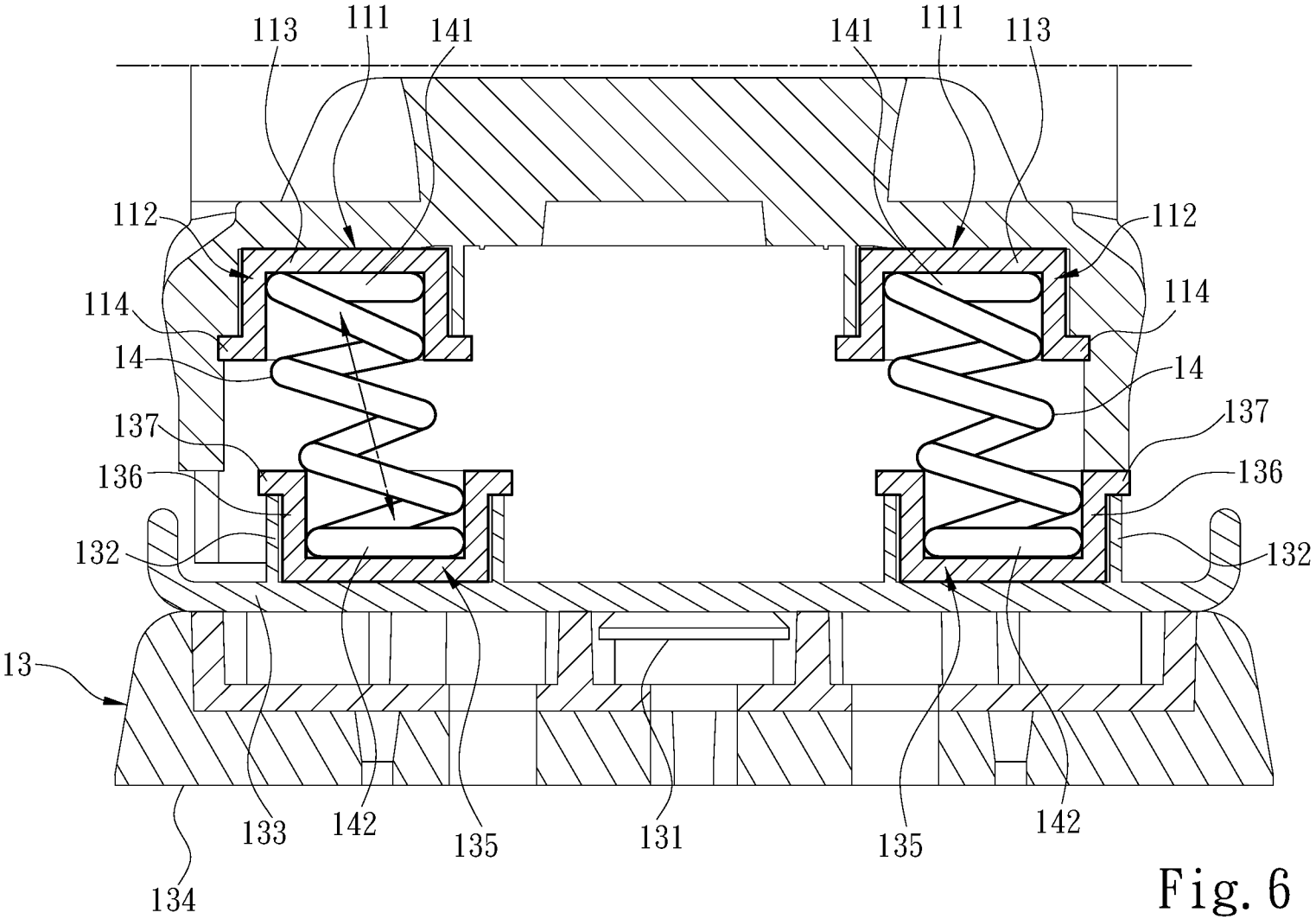
FIG. 6 is an implementation diagram of the sanding disc stabilizing structure according to the first embodiment of the invention.

Please refer to FIG. 5 and FIG. 6. The casing 11 is provided with a plurality of first installation holes 111, and each of the plurality of first installation holes 111 is located at the installation part of the casing 11 provided for the first end 141 of each of the at least four springs 14. The opening of the first installation hole 111 faces the sanding disc 13. Each of the plurality of the first installation holes 111 is a round hole. The opening diameter of each of the plurality of the first installation holes 111 corresponds to the opening diameter of the first end 141 of each of the at least four springs 14. In addition, each of the plurality of the first installation holes 111 comprises an adequate depth to increase the stability of each of the at least four springs 14 after installation. It should be noted that the length of each of the at least four springs 14 placed into one of the plurality of the first installation holes 111 is limited not to affect the normal operation the springs 14. In order to prevent the at least four springs 14 from taking apart when the orbital sander 10 is started, in one embodiment, the casing 11 further comprises a plurality of first rubber sleeves 112 respectively disposed in the each of the plurality of the first installation holes 111. Each of the plurality of the first rubber sleeves 112 is a solid plastic body capable of deforming appropriately, such as rubber, etc. The plurality of the first rubber sleeves 112 enable the plurality of the first ends 141 of the at least four springs 14 to obtain greater restraining force, and to be stably disposed in the plurality of the first installation holes 111. In addition, each of the plurality of the first rubber sleeves 112 comprises a first cap 113 placed into one of the plurality of first installation holes 111, and a first flange 114 extending from the periphery of the first cap 113 and disposed at an opening edge of the first installation hole 111.

Please refer to FIG. 5 and FIG. 6. The sanding disc 13 is provided with a plurality of second installation holes 132, and each of the plurality of second installation holes is located at the installation part of the sanding disc 13 provided for the second end 142 of each of the at least four springs 14. The design concept of the plurality of the second installation hole 132 is the same as that of the plurality of the first installation hole 111, and thus will not be repeated here. In addition, the sanding disc 13 comprises a base disc 133 and a sanding pad 134 disposed on the base disc 133. The plurality of the second installation holes 132 are formed on a side of the base disc 133 facing the casing 11. The openings of the plurality of the second installation holes 132 face the casing 11. In one embodiment, the sanding disc 13 comprises a plurality of the second rubber sleeves 135 respectively disposed in the plurality of the second installation holes 132, and the second end 142 of each of the at least four springs 14 is disposed in one of the plurality of the second rubber sleeves 135. The plurality of the second rubber sleeves 135 are the same as the plurality of the first rubber sleeves 112, which are solid plastic bodies capable of deforming appropriately to provide greater restraining force for the second end 142 of each of the at least four springs 14 so that the second end 142 of each of the at least four springs 14 is stably disposed in one of the plurality of the second installation holes 132. Furthermore, each of the plurality of the second rubber sleeves 135 comprises a second cap 136 placed into one of the plurality of second installation holes 132, and a second flange 137 extending from a periphery of the second cap 136 and disposed at an opening edge of the second installation holes 132.

Figure 9:
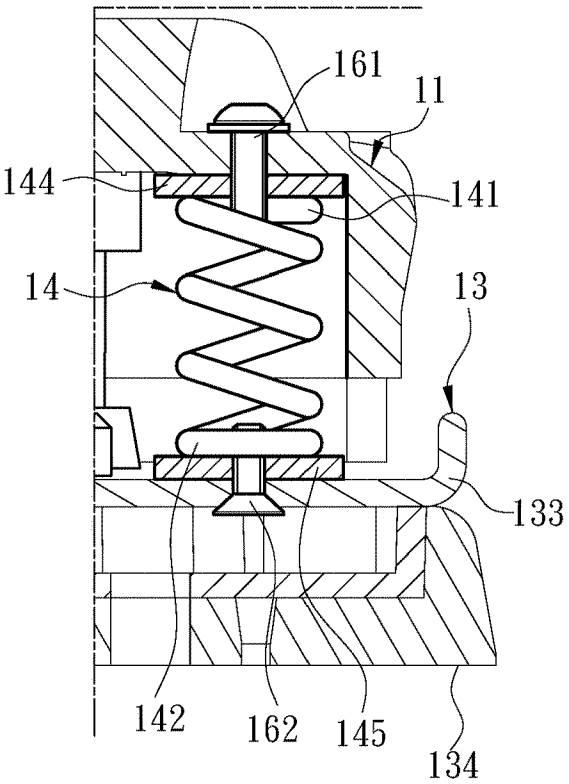
FIG. 9 is a structural diagram of the sanding disc stabilizing structure according to a third embodiment of the invention.
Figure 8:
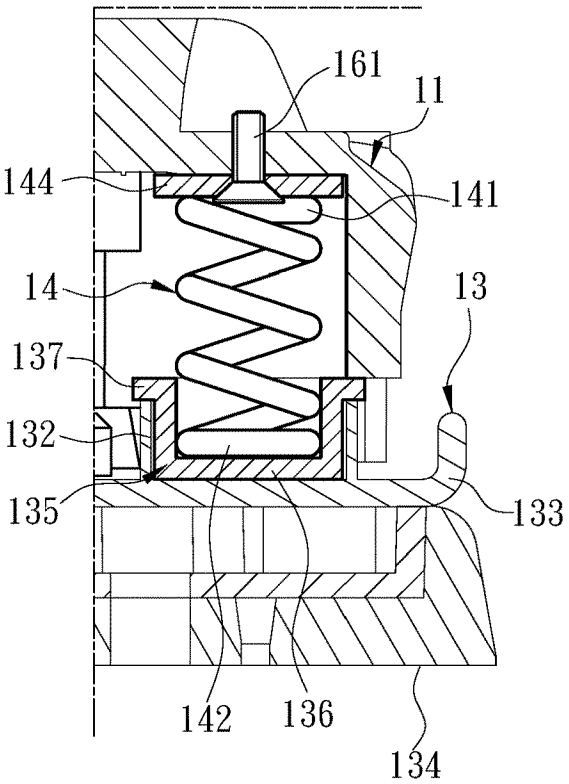
FIG. 8 is a structural diagram of the sanding disc stabilizing structure according to a second embodiment of the invention.

Please refer to FIG. 8. The installation of the at least four springs 14 of the invention is described hereinafter. In one embodiment, each of the at least four springs 14 comprises a first assembling connector 144 disposed at the first end 141 and fixed to the casing 11 through a first assembling element 161. The first assembling connector 144 is not an integral part of the spring 14. The first assembling connector 144 is assembled on a main body of the spring 14 through machining or its own structural design. Furthermore, a portion of the casing 11 which provided for the first assembling element 161 to be assembled thereon is not limited to the form that the first assembling element 161 is penetrated into the casing 11 as depicted in the drawing, it is adjustable according to the design of the casing 11. In addition, the form of the first assembling element 161 is not limited to a screw as depicted in the drawing. Any structure which can achieve the connecting function belongs to the implementation scope of the first assembling element 161 and the first assembling connector 144 in this specification. Please refer to FIG. 9. In one embodiment, each of the at least four springs 14 comprises a second assembling connector 145 disposed at the second end 142 and provided for a second assembling element 162 to dispose therein. The forming method and implementation scope of the second assembling connector 145 are the same as those of the first assembling connector 144, and thus will not be repeated here. It should be noted that whether each of the at least four springs 14 comprises the first assembling connector 144 or the second assembling connector 145 is adjustable according to implementation requirements, and is not limited by the embodiments provided in the drawings.

Figure 10:
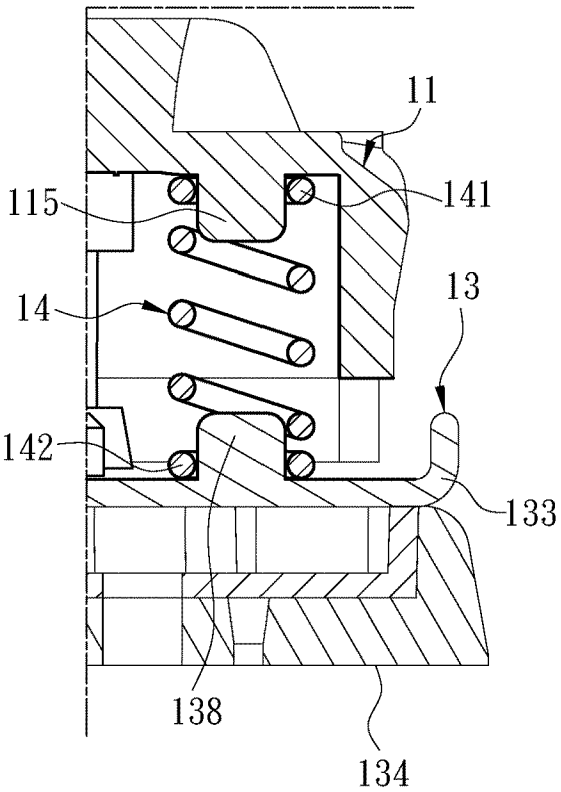
FIG. 10 is a structural diagram of the sanding disc stabilizing structure according to a fourth embodiment of the invention.

Please refer to FIG. 10. In one embodiment, the installation part of the casing 11 provided for the first end 141 of each of the at least four springs 14 is a first protruding column 115, and the first protruding column 115 is provided for sleeving the first end 141 of the spring 14 thereon. In order to increase an assembling strength between the first protruding column 115 and the spring 14, an adhesive (not shown in the figure) is coated on the first protruding column 115 to assist in fixing. Furthermore, in order to prevent the spring 14 from displacing improperly, the size of the first protruding column 115 is consistent with the opening diameter of the spring 14 at the first end 141 thereof. In another embodiment, the installation part of the sanding disc 13 provided for the second end 142 of each of the at least four springs 14 is a second protruding column 138. The implementation concept of the second protruding column 138 is the same as that of the first protruding column 115, and thus will not be repeated here.

Figure 11:
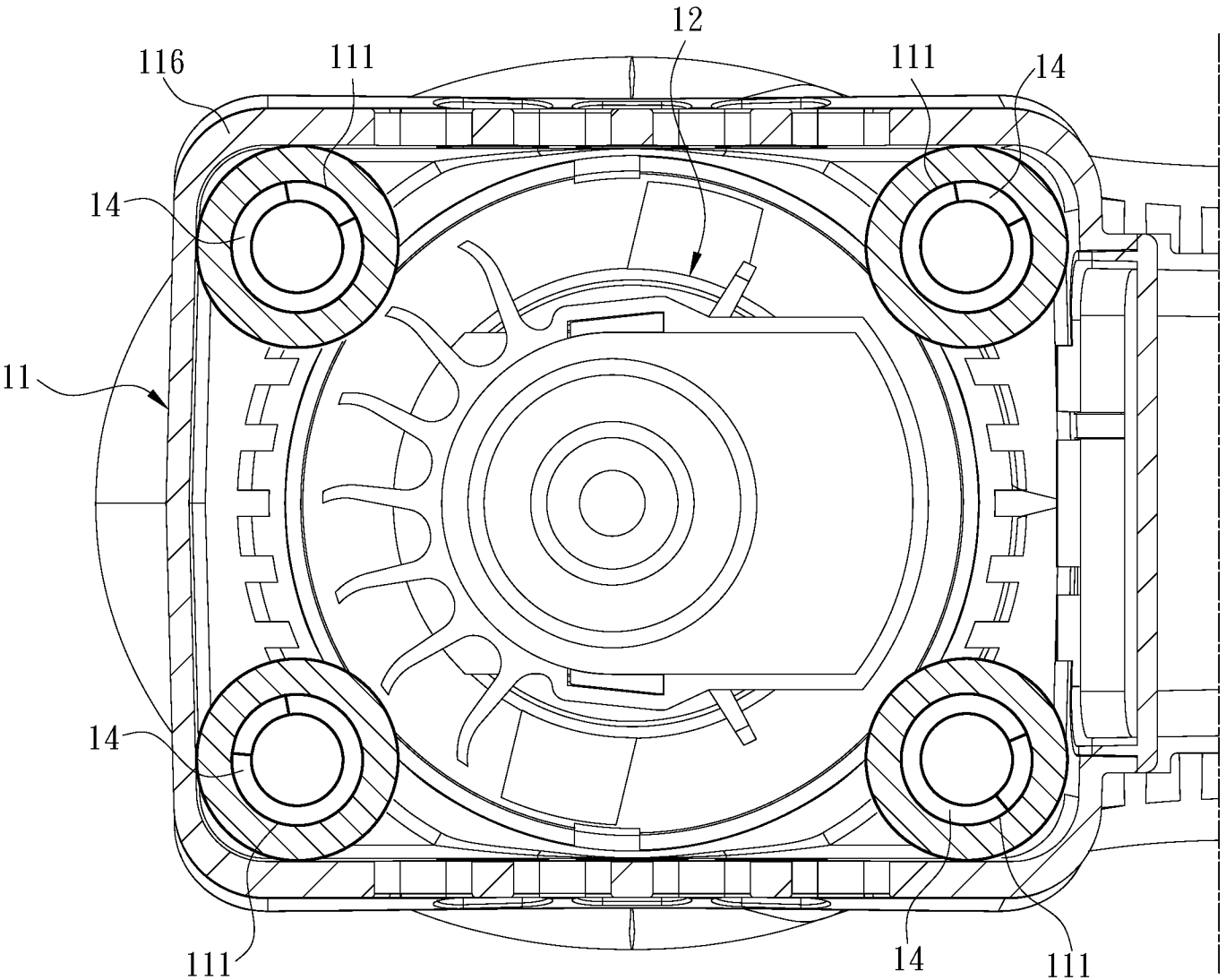
FIG. 11 is a partial structural diagram of the orbital sander according to the first embodiment of the invention.

Please refer to FIG. 11. In one embodiment, the casing 11 comprises a rectangular dust cover 116 facing the sanding disc 13, and the at least four springs 14 are located at corners of the rectangular dust cover 116.

What is claimed is:

1. A sanding disc stabilizing structure of an orbital sander, comprising:

a casing, provided with a plurality of first installation holes;

a sanding power source, assembled in the casing and the sanding power source comprising a drive shaft and a tool holder disposed on the drive shaft and offset from an axis of the drive shaft;

a sanding disc, a center of the sanding disc disposed on the tool holder with a locking screw, the sanding disc comprising a base disc and a sanding pad disposed on the base disc, the base disc formed with a plurality of second installation holes on a side facing the casing, and the sanding disc driven by the sanding power source to perform an orbital motion relative to the casing; and at least four springs, each of the at least four springs comprising a first end disposed in one of the plurality of first installation holes of the casing and a second end disposed in one of the plurality of second installation holes of the sanding disc, wherein a free length of each of the at least four springs is greater than a spacing between the first installation hole of the casing and the second installation hole of the sanding disk, so that the at least four springs are compressed within the spacing, and wherein each of the at least four springs is incompletely compressed in the spacing, and during the orbital motion of the sanding disc, each of the at least four springs is extended when the second end thereof deviates from a projection position of the first end;

wherein the plurality of first installation holes and/or the plurality of second installation holes is provided with a plurality of rubber sleeves, and the first end and/or the second end of the at least four springs are respectively disposed in the plurality of rubber sleeves;

wherein each of the plurality of rubber sleeves comprises a cap placed into the plurality of first installation holes or the plurality of second installation holes, and a flange extending from a periphery of the cap and disposed at an opening edge of the plurality of first installation holes or the plurality of second installation holes.

2. The sanding disc stabilizing structure of the orbital sander as claimed in claim 1, wherein each of the at least four springs comprises a first assembling connector disposed at the first end and fixed to the casing through a first assembling element.

3. The sanding disc stabilizing structure of the orbital sander as claimed in claim 1, wherein each of the at least four springs comprises a second assembling connector disposed at the second end and provided for a second assembling element to dispose therein.

4. The sanding disc stabilizing structure of the orbital sander as claimed in claim 1, wherein the first installation hole of the casing provided for the first end of each of the at least four springs is a first protruding column.

5. The sanding disc stabilizing structure of the orbital sander as claimed in claim 1, wherein the first installation hole of the sanding disk provided for the second end of each of the springs is a second protruding column.

6. The sanding disc stabilizing structure of the orbital sander as claimed in claim 1, wherein the casing comprises a rectangular dust cover facing the sanding disc, and the at least four springs are located at corners of the rectangular dust cover.

7. The sanding disc stabilizing structure of the orbital sander as claimed in claim 1, wherein the sanding disc is rectangular.

* * * * *